US009376945B2

(12) United States Patent
Wagner

(10) Patent No.: US 9,376,945 B2
(45) Date of Patent: Jun. 28, 2016

(54) TWO CIRCUIT ADJUSTABLE PCV VALVE

(75) Inventor: Matthew E. Wagner, Kutztown, PA (US)

(73) Assignee: M.E. Wagner, LLC, Bear Creek, PA (US)

( * ) Notice: Subject to any disclaimer, the term of this patent is extended or adjusted under 35 U.S.C. 154(b) by 32 days.

(21) Appl. No.: 13/565,964

(22) Filed: Aug. 3, 2012

(65) Prior Publication Data

US 2014/0034031 A1 Feb. 6, 2014

(51) Int. Cl.

*F02B 25/06* (2006.01)
*F01M 13/02* (2006.01)
*F01M 13/00* (2006.01)

(52) U.S. Cl.

CPC ..... *F01M 13/023* (2013.01); *F01M 2013/0044* (2013.01)

(58) Field of Classification Search

USPC ..... 123/41.86, 573, 574; 137/512.1, 493, 137/493.8, 218, 625, 530, 15.17, 15.18, 137/15.21, 15.22, 15.24, 49, 825, 829, 832, 137/835, 837

See application file for complete search history.

(56) References Cited

U.S. PATENT DOCUMENTS

| | | | | |
|---|---|---|---|---|
| 4,856,487 | A | 8/1989 | Furuya | |
| 5,586,541 | A * | 12/1996 | Tsai | 123/574 |
| 5,845,626 | A * | 12/1998 | Hou | 123/585 |
| 7,775,198 | B2 | 8/2010 | Shieh | |
| 7,900,612 | B2 | 3/2011 | Knaus et al. | |
| 2010/0077972 | A1 * | 4/2010 | Doers | 123/41.86 |

* cited by examiner

*Primary Examiner* — John Kwon
*Assistant Examiner* — Ruben Picon-Feliciano
(74) *Attorney, Agent, or Firm* — Sanford J. Piltch

(57) ABSTRACT

A two circuit manually adjustable PCV valve has threaded control means for adjusting the blow by gas flow in idle (high) and cruise (low) vacuum conditions. A third adjustment means for controlling the crossover flow rate between the channels in certain modes of operation renders the vacuum pressure transition point susceptible to manual control. The three adjustment means create a control system for more efficient vehicle engine operation.

10 Claims, 6 Drawing Sheets

TWO CIRCUIT ADJUSTABLE PCV VALVE

BACKGROUND OF THE INVENTION

The present invention relates to an internal combustion engine gas flow rate control system and, more particularly, to a gas flow rate control system for controlling the recirculation of gas discharge from the engine back to the same engine in accordance with engine operating conditions and also in accordance with flow rate adjustments made to the gas flow rate control system.

A crankcase ventilation system is a way for gases to escape in a controlled manner from the crankcase of an internal combustion engine. A common type of such system is a positive crankcase ventilation (PCV) system. The heart of this system is a PCV valve—a single channel variable-restriction valve that can react to changing pressure values and intermittently vary flow rates while allowing the passage of the gases to their intended destination. In most modern vehicles the intended destination is the engine's intake stream.

Internal combustion inevitably involves a small but continual amount of blow-by gases, which will occur when some of the gases from the combustion leak past the piston rings to end up inside the crankcase. The gases could be vented through a simple hole or tube directly to the atmosphere, or they could "find their own way out" past baffles or past the oil seals of shafts or the gaskets of bolted joints. This is not a problem from a mechanical engineering viewpoint alone; but from other viewpoints, such as cleanliness for the user and environmental protection, such simple ventilation methods are not enough; escape of oil and gases must be prevented via a closed system that routes the escaping gases to the engine's intake stream and allows fresh air to be introduced into the crankcase for better and more efficient combustion.

From late in the 19th century through the early $20^{th}$ century, blow-by gases were allowed to find their own way out past seals and gaskets in automotive vehicles. It was considered normal for oil to be found both inside and outside an engine, and for oil to drip to the ground in small but constant amounts. This was also true for steam engines and steam locomotives in the decades before. Bearing and valve designs generally made little to no provision for keeping oil or waste gases contained. Sealed bearings and valve covers were only for special applications. For example, oilers kept the locomotives and rolling stock of railroads continually supplied with oil both inside and out. Although it was applied sparingly to oil cups and oil holes, it was not expected to stay hermetically sealed off from dripping and leaking to the wider environment. At the time, gaskets and shaft seals were meant only to limit loss of oil and were usually not expected to entirely prevent it. In internal combustion engines, the hydrocarbon-rich blow-by gases would diffuse through the oil in the seals and gaskets into the atmosphere. Engines with high amounts of blow-by (e.g., worn out ones, or ones not well built to begin with) would leak profusely.

From 1928 until the early 1960s, car and truck gasoline operated internal combustion engines vented combustion gases directly to the atmosphere through a simple vent tube. Frequently, this consisted of a pipe (the 'road draft tube') that extended out from the crankcase down to the bottom of the engine compartment. The bottom of the pipe was open to the atmosphere, and was placed such that when the car was in motion a slight vacuum was obtained, helping to extract combustion gases as they collected in the crankcase. The vacuum was satisfied by a vent, typically in the valve or valley cover, creating a constant flow of clean air through the engine's air volume. The oil mist would also be discharged, resulting in an oily film being deposited in the middle of each travel lane on heavily-used roads. The system was not positive though, as gases could travel both ways, or not move at all, depending on conditions.

During the World War II years, a different manner of crankcase ventilation had to be invented to allow tank engines to operate during deep fording operations where the normal draft tube ventilator would have allowed water to enter the crankcase and destroy the engine. The PCV system and its control valve were invented to meet this need, but a need for this system on automobiles was not recognized.

In 1952, a professor at the California Institute of Technology, postulated that unburned hydrocarbons were a primary constituent of smog, and that gasoline powered automobiles were a major source of those hydrocarbons. After further investigation by the GM Research Laboratory, it was discovered that the road draft tube was a major source of the hydrocarbons coming from the automobile. GM's Cadillac Division, which had built many tanks during World War II, recognized that the PCV valve could be used to become the first major reduction in automotive hydrocarbon emissions. After confirming the PCV valves' effectiveness at hydrocarbon reduction, GM offered the PCV solution to the entire U.S. automobile industry, royalty free, through its trade association, the Automobile Manufacturers Association (AMA). In the absence of any legislated requirement, the AMA members agreed to put it on all California cars voluntarily beginning in 1961, with national application following one year later.

The PCV valve is only one part of the positive crankcase ventilation system, which is essentially a variable and calibrated air leak, whereby the engine returns its crankcase combustion gases. Instead of the gases being vented to the atmosphere, these gases are fed back into the intake manifold, re-entering the combustion chamber as part of a fresh charge of air and fuel. All the air collected by the air cleaner (and metered by the mass flow sensor, on a fuel injected engine) goes through the intake manifold. The PCV system just diverts a small percentage of this air via the breather to the crankcase before allowing it to be drawn back into the intake tract again. The positive crankcase ventilation system is an "open system" in that fresh exterior air is continuously used to flush contaminants from the crankcase and into the combustion chamber.

The system relies on the fact that, while the engine is running under light load and moderate throttle opening, the intake manifold's pressure is always less than crankcase pressure. The lower pressure of the intake manifold draws gases towards it, pulling air from the breather through the crankcase where the air is diluted and mixed with combustion gases through the PCV valve, and returned to the intake manifold.

The positive crankcase ventilation system usually consists of the breather tube and the PCV valve. The breather tube connects the crankcase to a clean source of fresh air—the air cleaner body. Usually, clean air from the air cleaner flows into this tube and into the engine after passing through a screen, baffle, or other simple system to arrest a flame front in order to prevent a potentially explosive atmosphere within the engine crankcase from being ignited from a backfire into the intake manifold. The baffle, filter, or screen also traps oil mist, and keeps it inside the engine. Once inside the engine, the air circulates around the interior of the engine, picking up and clearing away combustion byproduct gases, including any substantive amounts of water vapor which includes dissolved chemical combustion byproducts. The combined gases then exit through another simple baffle, screen, or mesh to trap oil droplets before being drawn out through the PCV valve and into the intake manifold.

The PCV valve connects the crankcase to the intake manifold from a location on the internal combustion engine more-or-less opposite the breather connection. Typical locations include the opposite side valve cover that the breather tube connects to on a V-shaped engine block. A typical location for the PCV valve is on a valve cover, although some engines place the valve in locations far from the valve cover.

The valve is simple, but actually performs a complicated control function. An internal restrictor (generally a cone or ball) is held in "normal" (engine off, zero vacuum) position with a light spring, exposing the full size of the PCV opening to the intake manifold. With the engine running, the tapered end of the cone is drawn towards the opening in the PCV valve by manifold vacuum, restricting the opening proportionate to the level of engine vacuum vs. spring force. At idle, the intake manifold vacuum is near maximum. It is at this time the least amount of blow by is actually occurring, so the PCV valve provides the largest amount of (but not complete) restriction. As engine load increases, vacuum on the valve decreases proportionally and blow by increases proportionally. With a lower level of vacuum, the spring returns the cone to the "open" position to allow more air flow. At full throttle, vacuum is much reduced, down to between 1.5 and 3 inches of Hg. At this point the PCV valve is nearly useless, and most combustion gases escape via the "breather tube" where they are then drawn into the engine's intake manifold. Should the intake manifold's pressure be higher than that of the crankcase (which can happen in a turbocharged engine, or under certain conditions of use, such as an intake backfire), the PCV valve closes to prevent reversal of the exhausted air back into the crankcase again.

It is critical that the parts of the PCV system be kept clean and open, otherwise air flow will be insufficient. A plugged or malfunctioning PCV system will eventually damage an engine. PCV problems are primarily due to neglect or poor maintenance, typically engine oil change intervals that are inadequate for the engine's driving conditions. A poorly-maintained engine's PCV system will eventually become contaminated with sludge, causing serious problems. If the engine's lubricating oil is changed with adequate frequency, the PCV system will remain clear practically for the life of the engine. However, since the valve is operating continuously as one operates the vehicle, it will fail over time. Typical maintenance schedules for gasoline engines include PCV valve replacement whenever the air filter or spark plugs are replaced. The long life of the valve despite the harsh operating environment is due to the trace amount of oil droplets suspended in the air that flows through the valve that keep it lubricated.

Most gasoline powered internal combustion engines still utilize PCV valves. The basic design of the PCV valve has not changed much in the more than 40 years since its first introduction on passenger vehicles. The existing single channel valve design works well on stock engines, but efficient operation still depends on system maintenance to prevent blockages.

The operating characteristics that define a PCV valve are: idle flow rate; cruise flow rate; and transition vacuum level. Idle flow rate is the determination of the quantity of gas flowing through the PCV valve during high vacuum conditions existing when an engine is idling. Cruise flow rate is the determination of the quantity of gas flowing through the PCV valve during low vacuum conditions when the engine is operating at higher rpm's during, for example, vehicle acceleration. Transition vacuum level is the vacuum level at which the PCV valve switches from a low to a high flow rate.

There are certain physical characteristics of stock PCV valves that can severely limit their utility. Usually, a given PCV valve is designed to operate efficiently with one specific engine type. The physical characteristics of the PCV valve are designed for proper operation of the engine type with which it is paired. The spring strength of the PCV valve is dictated to cause the PCV valve piston to operate between low and high flows depending upon the vacuum level that exists at the transition point. Internal flow rates of the PCV valve are dictated by the piston to body clearance and the taper of the piston in relation to the internal shape of the single channel body. Since PCV valves are manufactured and sold as sealed units, it is difficult, if not impossible, to determine the various specifications for the variety of PCV valves presently on the market.

High performance engines almost always have a non-standard engine combination for which a stock PCV valve will not operate efficiently, or not work at all. A mismatched valve can have an insufficient flow rate, in which case the crankcase will not be ventilated properly. Also a mismatched PCV valve may have an excessive flow rate, which may lead to engine tuning difficulties and possible spark plug fouling. If the vacuum profile of the high performance engine does not match the vacuum profile of the stock PCV valve, proper opening and closing functionality of the valve will also be lost or greatly reduced, which can lead to both inadequate or excessive flow rates and the related issues already discussed.

In some instances, stock PCV valves will not seal completely against reverse flow under positive pressure conditions, such as in supercharged or turbocharged applications. If the PCV valve does not seal properly, the crankcase can be positively pressurized causing damage to the engine. Lastly, in some extreme performance applications, the engine does not generate sufficient vacuum to close any type of PCV valve properly. In this case, a fixed orifice type valve is desired, whereby the vapors flow through a fixed flow restriction. Although stock type fixed orifice PCV valves do exist, they do not offer the ability for the user to alter the flow rate through the fixed flow restriction.

In order to overcome the stated deficiencies the present invention relies upon a dual channel or dual circuit PCV valve where each circuit is manually adjustable for greater response and efficiency. Standard PCV valves are designed to operate within the known parameters of a single engine type. These valves are not adjustable, but are rather sealed units preset for functioning by their internal design and operational parameters. As stated above, in high performance circumstances, or with non-standard engine operating parts, stock PCV valves will not properly function as intended and may cause more serious problems over time to engine efficiency and wear. The adjustable two circuit PCV valve allows for the appropriate adjustment of each circuit, high and low vacuum, to the operational characteristics of the engine.

It is, thus, one object of the present invention to provide two independent channels or circuits, one for idle (high vacuum) and one for cruise (low vacuum), in a PCV valve. It is also an object of the present invention to provide individual manual adjustment control over each of the high and low vacuum circuits, i.e., the idle and cruise circuits, to permit a more appropriate setting for operational response of the engine. It is a further object of the present invention to provide a better manual control over the baseline flow rate of the blow by gases and to more accurately set the vacuum level for transition from low to high flow through the PCV valve. It is a still further object of the present invention to provide a PCV valve which will seat against the reverse flow under positive pressure conditions, such as boost in a turbocharged or supercharged application. It is yet a further object of the present invention to provide an orifice between the two circuits to also control the amount of additional gas flow when the engine is in cruise mode.

Other objects will appear hereinafter.

SUMMARY OF THE INVENTION

A two channel, or two circuit, PCV valve has one of its circuits dedicated to the cruise or low vacuum pressure control and the other of its circuits dedicated to the idle or high vacuum pressure control. Manual controls operated by threadedly moving the adjustment controls inward and outward are capable of changing the vacuum pressure point where the ball valve operates to transition between each of the two circuits. Another manual control operated by threadedly moving the adjustment inward and outward can be used to adjust the overall flow rate through the circuits. An additional manual adjustment control may be used to control the rate of flow through a crossover port between the two circuits by regulating the dimensional space through which the blow by gas flows.

The present invention may be summarized as a multi-pathway positive crankcase ventilation (PCV) valve that is comprised of a first fluid channel connecting a first fluid inlet port from the engine crankcase and a vacuum port outlet to the engine manifold air intake and a second fluid channel connecting a second fluid inlet port from the engine crankcase and a vacuum port outlet to the engine manifold air intake, the second fluid channel having a primary outlet and a secondary outlet to the vacuum port. A first ball valve is operable within the first fluid channel and is responsive to engine vacuum pressure to permit or deny passage of blow by gas from the engine crankcase through said PCV valve. The first ball valve is responsive to a spring adjuster operable to increase or decrease the spring force on the ball valve by exerting control on the first ball valve to open or close the first fluid channel between said first channel inlet and outlet ports. The spring adjuster is utilized for setting the pressure responsiveness of the first ball valve and is manually settable by the inward and outward motion of a cooperating threaded screw extending through the top of the PCV valve.

A second ball valve is operable within the second fluid channel and is responsive to engine vacuum pressure to permit or deny passage of blow by gas from the engine crankcase through the primary outlet port of the second fluid channel. The second ball valve is responsive to high and low vacuum through the PCV valve to open or close the first fluid channel between the second channel fluid inlet and primary outlet ports. A second adjuster is operable to increase or decrease the amount of blow by gas flowing through the secondary outlet port in the second fluid channel when the second ball valve closes off the primary outlet port of the second fluid channel. The second adjuster for setting the spatial dimension of the secondary outlet port for controlling the flow of blow by gas through the secondary outlet port of the second fluid channel being manually settable by the inward and outward motion of a cooperating threaded screw extending through the top of the PCV valve.

A crossover port connecting the first and second fluid channels arranged such that the crossover port permits blow by gas to flow between the first and second channels depending upon the open or closed position of the respective first and second ball valve. This structural arrangement and interoperative functioning results in the PCV valve being manually controllable in each of the first and second fluid channels for enhanced control over the operational parameters of the PCV valve creating more efficient engine responses in both low and high vacuum operation.

The multi-pathway PCV valve further comprises a third adjuster for controlling the rate of flow of blow by gas between the first and second fluid channels extending into the crossover port flow channel and being manually settable by the inward and outward motion of a cooperating threaded screw extending through the bottom of the PCV valve. The rate of flow of the blow by gases through the crossover port may be controlled through the increase or decrease of the diameter of the crossover port. The rate of flow of the blow by gases through the crossover port may also be controlled through the increase or decrease of the depth of the crossover port. The rate of flow of the blow by gases through the crossover port can also be controlled through the increase or decrease of the flow channel of the crossover port by altering the inward position of the crossover port plug.

The functional characteristics of the multi-pathway PCV valve can be manipulated by the utilization of the adjusters of the PCV valve. The high/low transition point of the PCV valve may be altered by the inward and outward adjustment of the spring adjuster. The pressure or vacuum level is adjustable to increase or decrease the pressure level at which transition occurs. The overall flow rate of gases through the PCV valve may be altered by the inward and outward adjustment of the second adjuster. Lastly, the spring adjuster can be manipulated to fully open or fully close said first fluid channel disabling the spring adjuster and operating the PCV valve in a fixed orifice mode.

BRIEF DESCRIPTION OF THE DRAWINGS

For the purpose of illustrating the invention, there is shown in the drawings forms which are presently preferred; it being understood, however, that the invention is not limited to the precise arrangements and instrumentalities shown.

DETAILED DESCRIPTION OF THE PREFERRED EMBODIMENTS

The following detailed description is of the best presently contemplated mode of carrying out the invention. The description is not intended in a limiting sense, and is made solely for the purpose of illustrating the general principles of the invention. The various features and advantages of the present invention may be more readily understood with reference to the following detailed description taken in conjunction with the accompanying drawings.

Figure 1:
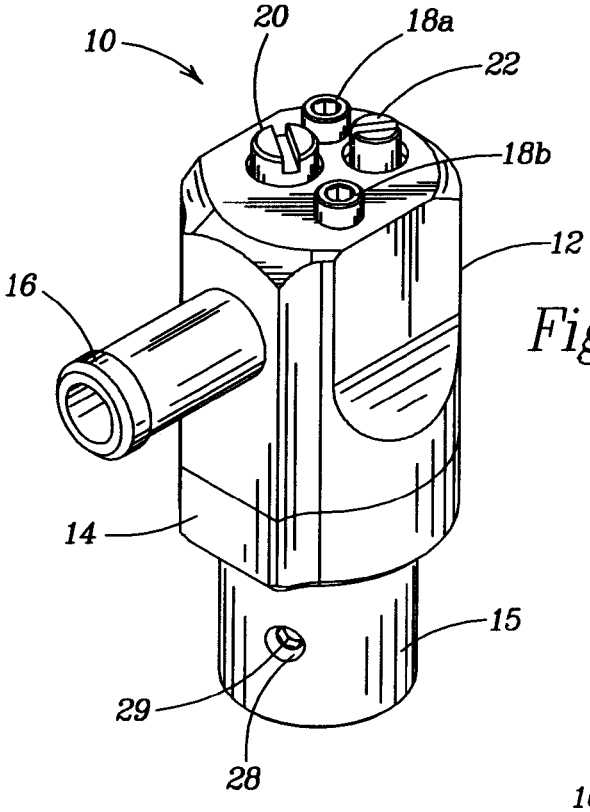
FIG. 1 is an isometric view of the two circuit PCV valve of the present invention viewed looking slightly downward.
Figure 1A:
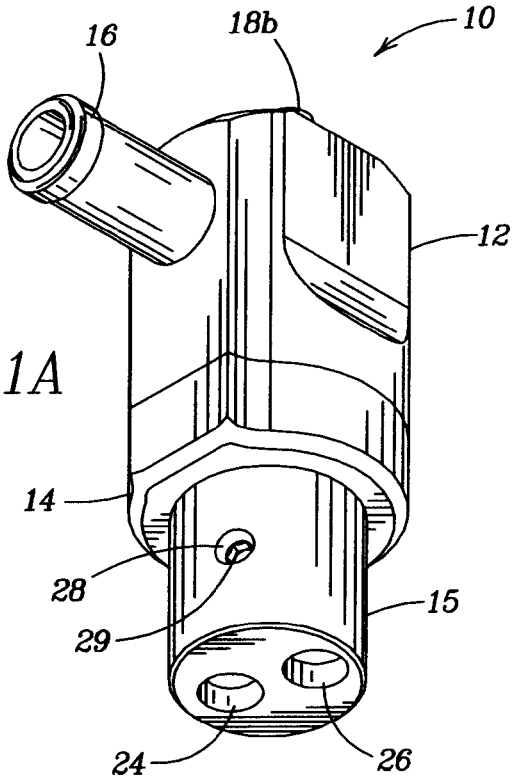
FIG. 1A is an isometric view of the two circuit PCV valve showing the bottom ports of the present invention.

Referring now to the drawings in detail, where like numerals refer to like parts or elements, there is shown in FIG. 1 and FIG. 1A the two channel or two circuit adjustable PCV valve 10 of the present invention. The adjustable PCV valve 10 is comprised of two major parts, an upper valve body 12 and a lower valve base 14. Emanating from the upper valve body 12 is the vacuum passage 16 that fluidly connects through an elongated connector (not shown) to the vehicle intake manifold. Also shown along the top surface of the upper valve body 12 are paired threaded fasteners 18*a*, 18*b* that hold the upper valve body 12 and the lower valve base 14 together. In addition the cruise circuit spring adjuster 20 and the idle circuit adjuster 22 are accessible from the top of the upper valve body 12 of the adjustable PCV valve 10.

The lower valve base 14 includes the cruise circuit inlet port 24 and the idle circuit inlet port 26 that extend through the bottom of the lower valve base 14. Also included is the cruise/idle circuit crossover port 28 that extends through the bottom cylindrical section 15 of the lower valve base 14. Capping the cruise/idle circuit crossover port 28 is plug 29.

Figure 2:
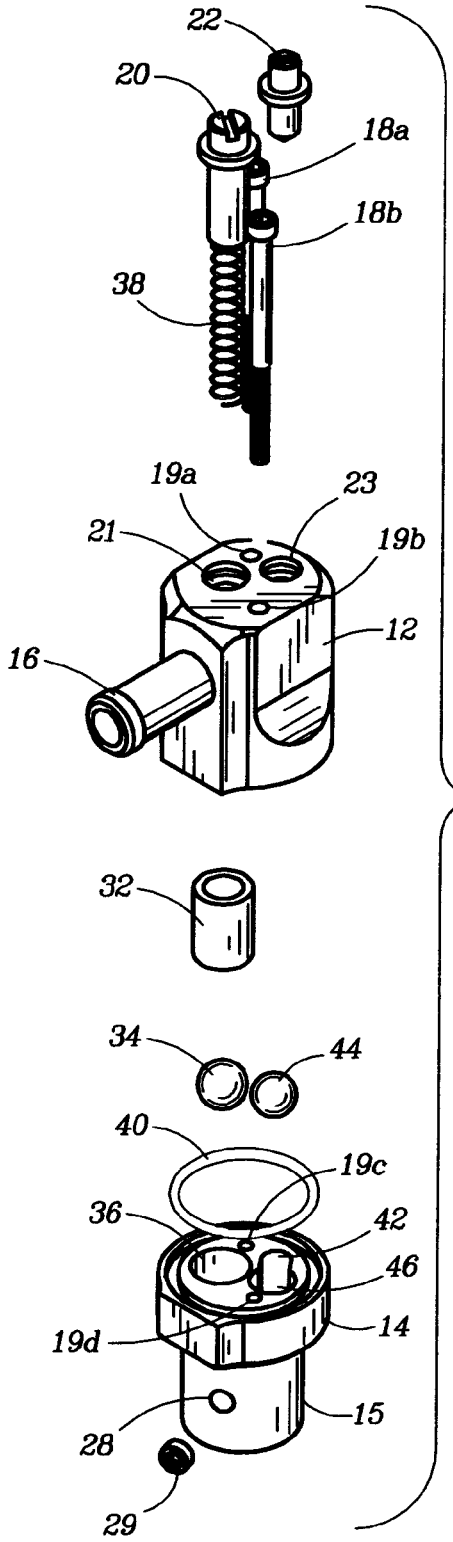
FIG. 2 is an exploded perspective view of the two circuit PCV valve of the present invention showing the various operational elements contained therein.

For ease in identifying each of the components and mechanisms of the adjustable PCV valve 10, reference should be had to FIG. 2 for a more complete understanding of the interrelated functioning of these items. Beginning with the upper section of FIG. 2, the upper valve body 12 has apertures 19*a* and 19*b* through which the paired threaded fasteners 18*a*, 18*b* extend and, when assembled with the lower valve base 14, cooperatively thread into threaded holes 19*c*, 19*d* to retain the two sections of the PCV valve 10 tightly together. Extending through the top of the upper valve body 12, and through threaded aperture 21, is the cruise circuit spring adjuster 20 that extends farther downward through a cruise spring guide bushing 32 contacting the cruise circuit ball valve closure 34. The cruise circuit spring adjuster 20 extends farther downward into the cruise circuit operations channel 36 that will house both the cruise circuit ball valve closure 34 and the cruise circuit spring 38 that is attached to the cruise circuit spring adjuster 20. The cruise circuit operations channel 36 extends through the lower valve base 14. Creating an airtight closure between the upper valve body 12 and the lower valve base 14 is an O-ring 40 which creates the seal between the upper and lower sections of the adjustable PCV valve 10.

Also extending through the top of the upper valve body 12, and through threaded aperture 23, is the idle circuit adjuster 22 that extends into the vacuum passage 16 and, when fully extended, abuts against the wall of vacuum passage 16 thus regulating flow through idle circuit metering port 42. The lower portion of such idle circuit metering port 42 is shown as the smaller diameter aperture in the top of the lower valve base 14. The idle circuit check ball valve 44 fits within the idle circuit operations channel 46 which extends through the lower valve base 14.

Figure 3:
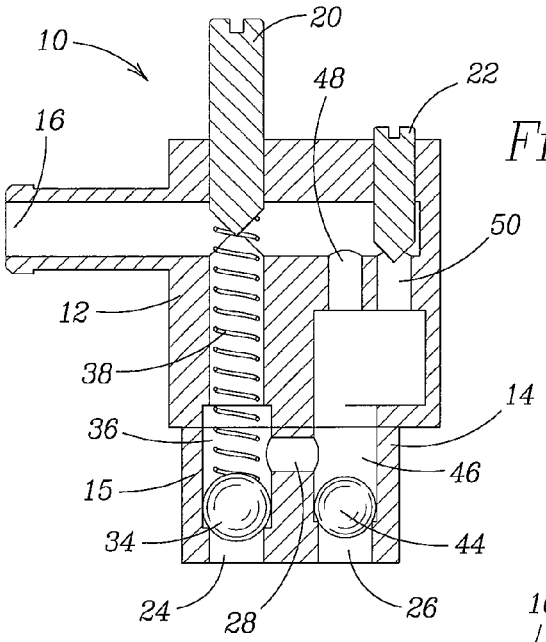
FIG. 3 is a cross-sectional view of the two circuit PCV valve of the present invention showing the valve in the engine off (zero vacuum), backfire (positive pressure), or boost condition for forced induction (positive pressure) position.

The operational characteristics of the present invention can be best described with reference to FIGS. 3-5 that are sectional views of the several different positionings of the operational control schemes of the present invention. FIG. 3 shows the cruise circuit spring adjuster 20 with the cruise circuit spring 38 fully extended such that the cruise circuit ball valve 34 is positioned at its farthest downward position at the bottom of the cruise circuit operations channel 36 to close off the cruise circuit inlet port 24. Likewise, the idle circuit ball valve 44 is also at its farthest downward position at the bottom of the idle circuit operations channel 46 to close off the idle circuit inlet port 26. The idle circuit operations channel 46 extends upward from the idle circuit inlet port 26 through the lower valve base 14 and into the upper valve body 12 terminating into the idle circuit valve ball actuation port 48 which connects to the vacuum passage 16.

Cut into the side of the idle circuit operations channel 46 is the idle circuit metering port 50 that, at its top opening, extends to the vacuum passage 16 and annularly mates with the idle circuit adjuster 22. Extending between the cruise circuit operations channel 36 and the idle circuit operations channel 46 is the cruise/idle circuit crossover port 28. The various elements shown in FIG. 3 are in the positions they would be in with the engine off and zero vacuum pressure through the vacuum inlet passage 16. These positions would also occur in the instance of a backfire, or if engine boost conditions were present for forced fuel induction causing positive pressure from the intake manifold. In the case of a backfire or engine boost conditions, the valve would prevent any positive pressure present in the inlet passage 16 from passing through the valve and into the engine crankcase.

Figure 4:
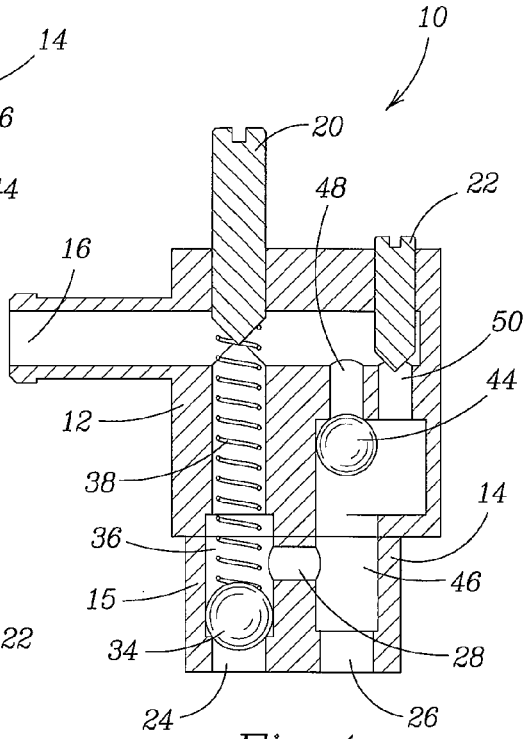
FIG. 4 is a cross-sectional view of the two circuit PCV valve of the present invention showing the valve in the cruise condition (low vacuum) position.

FIG. 4 shows the positions of the elements with the adjustable PCV valve 10 in cruise conditions with low vacuum present. With low vacuum, the idle circuit ball valve 44 has travelled upwards in the idle circuit operations channel 46 to rest against and close off the idle circuit valve ball actuation port 48 that causes the gases to move through the idle circuit metering port 50. The size of the opening at the top of the idle circuit metering port 50 is determined by the in and out adjustment of the idle circuit adjuster 22 that extends across the vacuum inlet passage 16. With the idle circuit ball valve 44 blocking the idle circuit valve ball actuation port 48 a substantial amount of the gases pass through the adjustment controlled opening at the top of the idle circuit metering port 50. With the low vacuum condition, the cruise circuit ball valve 34 is caused to lie against the cruise circuit inlet port 24 at the bottom of the cruise circuit operations channel 36 by the force of the spring 38. The position of the cruise circuit ball valve 34 allows additional flow from the idle circuit operations channel 46 to pass through the cruise/idle circuit crossover port 28 and through the cruise circuit operations channel 36. Thus, the overall flow in this mode of operation is governed by the flow through the idle circuit metering port 50 along with the flow through the cruise/idle circuit crossover port 28.

The force of the spring 38 is adjustable through the cruise circuit spring adjuster 20 that causes the proximal end of the spring 38 lying against the adjustment screw 20 to change position by raising or lowering the end of the adjustment screw 20 which, in turn, increases and decreases the force on the end of the spring 38. Turning the adjustment screw 20 inward results in more force on the cruise circuit ball valve 34, thus a higher vacuum level in cruise circuit operations channel 36 would be required to pull the cruise circuit ball valve 34 upward, thereby preventing additional flow from the idle circuit operations channel 46 from passing through the cruise/idle circuit crossover port 28 and through the cruise circuit operations channel 36. Likewise, turning the adjustment screw 20 outward results in less force on the cruise circuit ball valve 34, thus a lower vacuum level in the cruise circuit operations channel 36 would be required to pull the cruise circuit ball valve 34 upward, thereby preventing additional flow from the idle circuit operations channel 46 from passing through the cruise/idle circuit crossover port 28 and through the cruise circuit operations channel 36.

Figure 5:
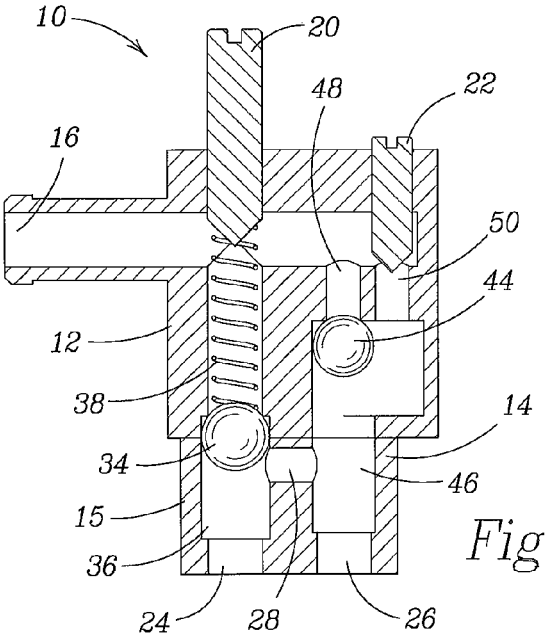
FIG. 5 is a cross-sectional view of the two circuit PCV valve of the present invention showing the valve in the idle condition (high vacuum) position.

FIG. 5 shows the position of the elements of the present invention in high vacuum conditions with the engine at idle. As in the low vacuum conditions shown in FIG. 4, the idle circuit ball valve 44 has travelled upwards in the idle circuit operations channel 46 to rest against and close off the idle circuit valve ball actuation port 48 that causes the gases to move through the idle circuit metering port 50. The spring force of spring 38 has been overcome by the vacuum pressure and the cruise circuit ball valve 34 has travelled upward far enough to block flow from the cruise/idle circuit crossover port 28 from entering cruise circuit operations channel 36, thus closing off the cruise circuit operations channel 36 flow completely.

The sole passage for the flow of gasses that remains open is the idle metering port 50 that is adjustably controlled for fluid passage by the idle circuit adjuster 22. The gases from the cruise circuit inlet port 24 flow through the cruise/idle circuit crossover port 28 combine with the gases that have flowed through the idle circuit inlet port 26 and flow upward through the idle operations channel 46 and the idle metering port 50 into the vacuum inlet passage 16.

Figure 6:
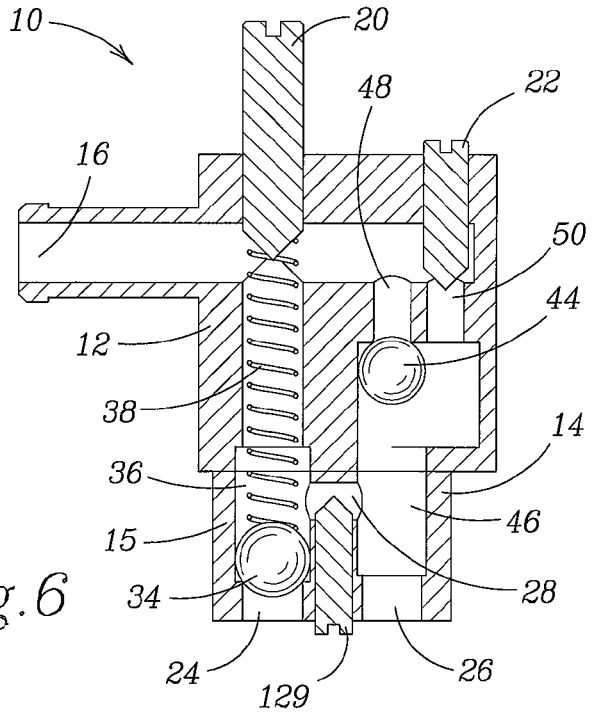
FIG. 6 is a cross-sectional view of the two circuit PCV valve of the present invention showing the valve having an alternate vertical flow adjustment of the cruise/idle crossover port.

An alternate embodiment provides for even more control over the crossover flow port 28. The flow of gasses through the cruise/idle crossover port 28 can be regulated in a number of ways. One such manual regulation of the gas flow is shown in FIG. 6. The crossover port 28 has a crossover adjuster 129 that is shown as a manually adjustable threaded screw capable of inward and outward motion to decrease or increase the flow diameter of the crossover port 28. Alternatively, an annular bore could be made between the cruise circuit operations channel 36 and the idle circuit operations channel 46 such that the bore only breaks through radially along the respective walls of channels 36, 46 creating a short distance crossover. A crossover adjuster (similar to crossover adjuster 129) can be inserted into the bore and controlled for inward and outward motion by cooperating threads in the bore and on the adjuster. With the manual inward and outward motion of the crossover adjuster the amount of gas flowing through the crossover port 28 is changed by altering the depth of the opening between the two channels 36, 46.

Figure 10:
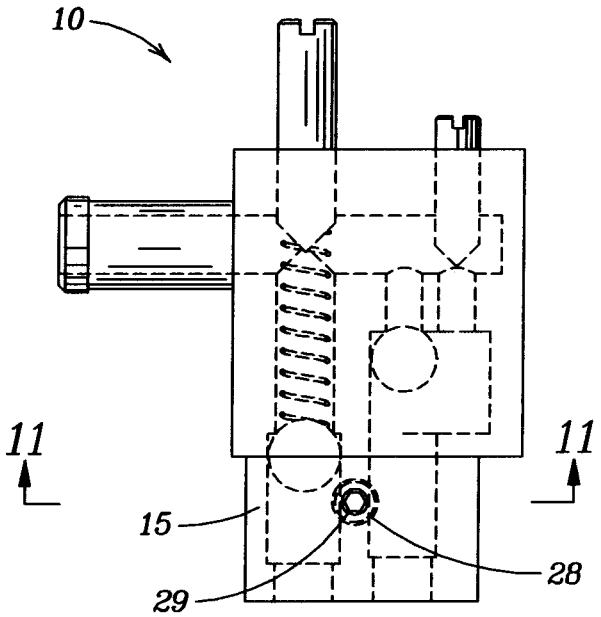
FIG. 10 is a cross-sectional view of the two circuit PCV valve of the present invention showing the laterally oriented cruise/idle circuit crossover port.
Figure 11:
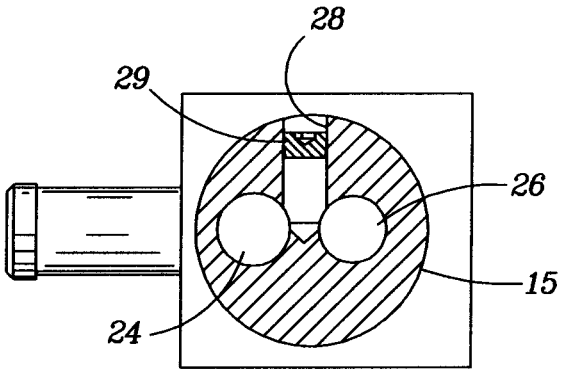
FIG. 11 is a sectional view taken along Line 11-11 of FIG. 10 showing the lateral flow adjustment of the cruise/idle circuit crossover port.

Lastly, the diameter of the cruise/idle crossover port 28 is a critical element in permitting gas flow from one side to the other. With reference to FIGS. 10 and 11 the crossover port 28 is shown laterally bored into the bottom cylindrical section 15 and impinging upon both the cruise circuit operations channel 26 and the idle circuit operations channel 46 at its distal end. The crossover port 28 in this embodiment is sealed by plug 29. As can be seen from the radial openings created in the respective walls of the cruise circuit inlet port 24 and the idle circuit inlet port 26 the diametric size of the crossover port 28 can be determinative of the rate of flow of the gaseous discharge through the crossover port 28. Altering the diameter of the crossover port 28 will change the crossover flow rate. Also, alteration of the length of the radial opening of each of the cruise circuit operations channel 26 and the idle circuit operations channel 46 can be achieved by altering the depth of the crossover port 28 bore hole. Thus, the predetermined diameter measurement of the crossover port 28 will restrict or increase the gas flow between the two channels 36, 46. Lastly, the plug 29, if inserted sufficiently far enough into the bore hole of the crossover port 28 can influence the rate of flow between the two channels 36, 46 by reducing the length of the radial openings in each of the channels opposing the crossover port 28.

Figure 7:
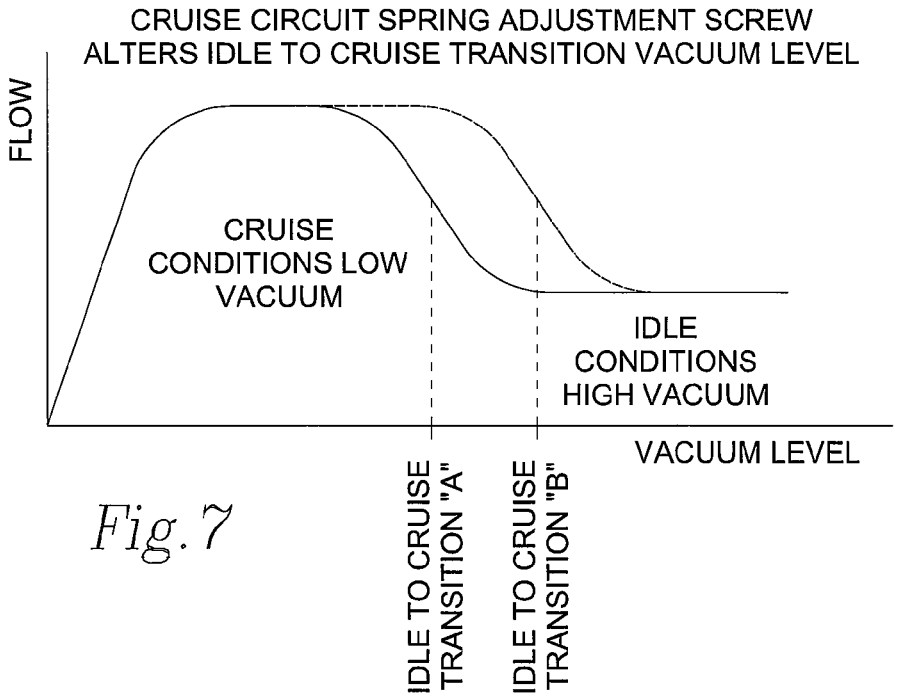
FIG. 7 is a graph showing the idle to cruise transitions associated with the position of the cruise circuit spring adjustment.

With reference to FIG. 7 one can see the advantages of permitting the manual adjustment of the transition point from cruise to idle conditions. By adjusting the cruise circuit spring adjuster 20 inward and outward the cruise to idle transition point is altered in the adjustable PCV valve 10. With the cruise circuit spring adjuster 20 not causing less compression of the spring 38, less vacuum pressure is required to overcome the spring force and move the cruise circuit ball valve 34 from its cruise position (FIG. 4) to its idle position (FIG. 5). Thus, as the cruise circuit spring adjuster 20 is withdrawn, the transition point moves from transition point B to transition point A.

Figure 8:
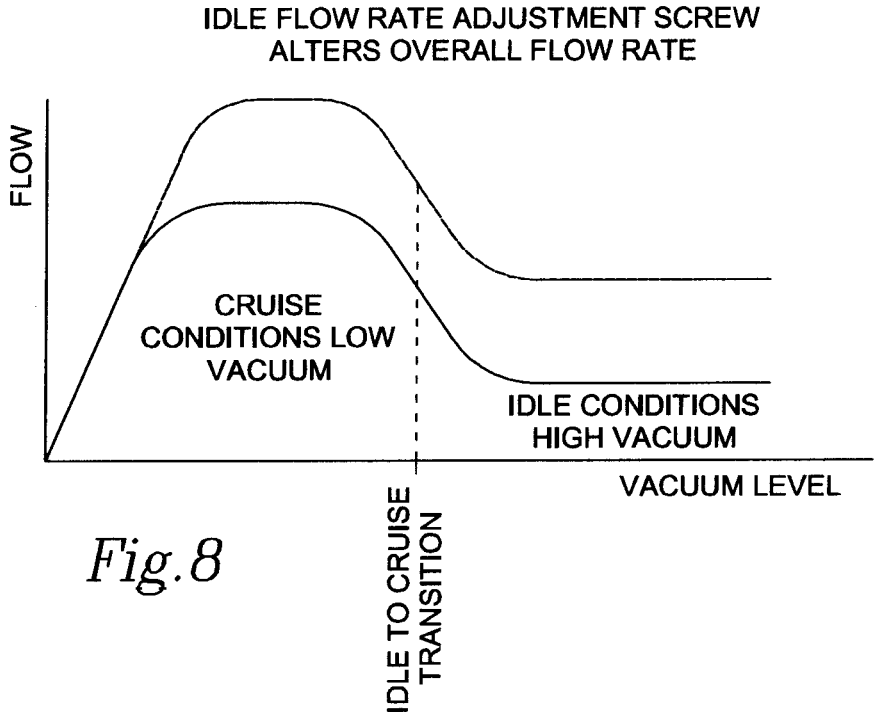
FIG. 8 is a graph showing the change of the overall flow rate associated with the position of the idle flow rate adjustment.
Figure 9:
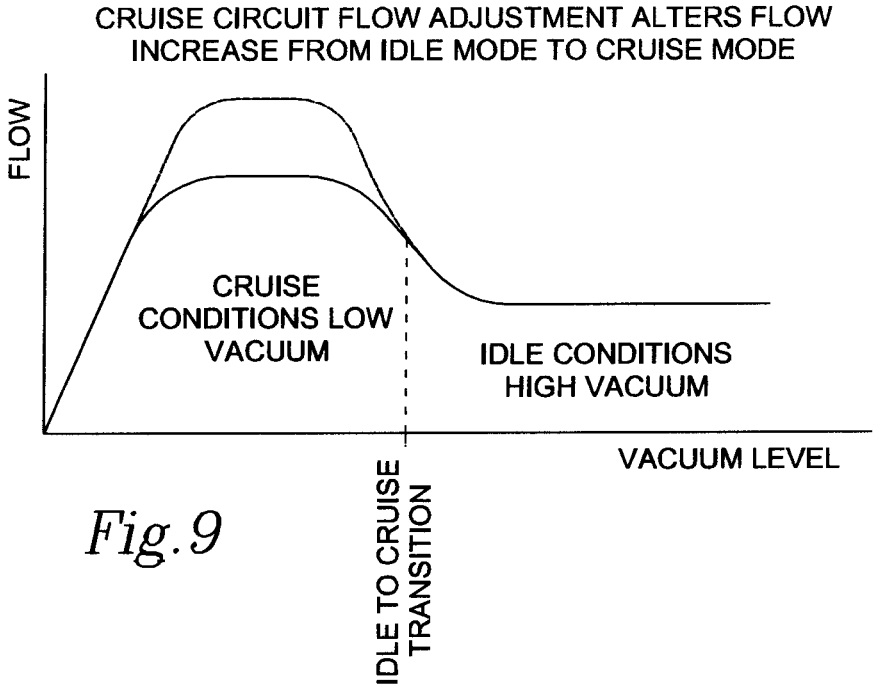
FIG. 9 is a graph showing the flow increase from the idle mode to cruise mode associated with altering the positions of the crossover adjustment.

The inward and outward motion of the idle circuit adjuster 22 will alter the overall flow rate of gases through the adjustable PCV valve 10. Looking at FIG. 8, the graph shows that the withdrawal of the idle circuit adjuster 22 causes the idle circuit metering port 50 to be less obstructed such that the gases flow through in greater quantity without adjustment of the idle to cruise transition point. In FIG. 9, the increase or decrease of the flow through the cruise/idle crossover port 28 is done by manually adjusting the crossover adjuster 29 inward and outward permitting greater or lesser crossover flow. Other means to alter the crossover flow rate such as altering the geometry, diameter or orientation of the crossover port 28 previously discussed may also be employed yielding the same result. In allowing greater flow by withdrawing the crossover adjuster 29 the transition point remains unchanged, but more gases are being moved through the adjustable PCV valve 10 when the valve is in cruise mode as illustrated in FIG. 4.

The present invention allows for much greater control over fluctuating engine conditions, i.e. vacuum or pressure in the intake manifold vs. pressure in the crankcase, by permitting the adjustment of the high and low vacuum flows, as well as the adjustment of the transition point separately from the flow controls. The long known and used single channel PCV valve cannot accomplish the minute adjustments required for high performance engines as can the adjustable PCV valve 10. Each of the three adjusters are independently manipulable so that high and low vacuum (idle and cruise) flow rates can be manually controlled for greater engine efficiency and control. Also, the high/low pressure transition point for the operation of the adjustable PCV valve 10 can also be adjusted to increase or decrease the vacuum at which operation occurs.

As another alternative, the adjustable PCV valve 10 can be made to operate in a fixed orifice mode, where the valve is not meant to open or close, rather it will cause a predetermined flow rate to pass through regulated by manipulating the idle circuit adjuster 22. In this case the cruise circuit can be disabled by turning the cruise circuit spring adjuster 20 either fully inward or fully outward, thereby holding the cruise circuit always open or always closed. This is similar to fixed orifice style stock PCV valves, however this alternative for operation provides the user with flow adjustment and also adds backfire/boost protection not found on most stock fixed orifice valves. None of these adjustments, or manipulations of the PCV valve, are available with the currently used PCV valves.

The present invention may be embodied in other specific forms without departing from the spirit or essential attributes thereof and, accordingly, the described embodiments are to be considered in all respects as being illustrative and not restrictive, with the scope of the invention being indicated by the appended claims, rather than the foregoing detailed description, as indicating the scope of the invention as well as all modifications which may fall within a range of equivalency which are also intended to be embraced therein.

The invention claimed is:

1. A positive crankcase ventilation (PCV) valve having multiple internal fluid channels and a plurality of manual adjusters operable for regulating fluid flow within the fluid channels based on engine operating conditions, the PCV valve comprising:

a first fluid channel inlet port and a second fluid channel inlet port connecting the PCV valve to the engine crankcase and combustion blow-by vapors contained therein;

a vacuum port outlet connecting the PCV valve to a vacuum port on the engine manifold air intake;

a first fluid channel fluidly connecting said first fluid channel inlet port and said vacuum port outlet;

a second fluid channel fluidly connecting said second fluid channel inlet port and said vacuum port outlet, said second fluid channel orifice having a primary outlet and a secondary outlet to said vacuum outlet port;

a crossover port channel fluidly connecting said first fluid channel to said second fluid channel, said crossover port channel remaining dimensionally unchanged in respect to engine manifold vacuum;

said first fluid channel including in its pathway a first ball valve biased by a spring and being operable within said first fluid channel in response to engine manifold vacuum such that in a first vacuum transition condition, when engine manifold vacuum exceeds a preset vacuum transition level or idle mode, said first ball valve blocks fluid flow from said crossover port channel through said first fluid channel into the vacuum port outlet and in a second vacuum transition condition or cruise mode, when engine manifold vacuum is below said preset vacuum transition level, the first ball valve exposes said crossover port channel to vacuum present in the vacuum port outlet due to spring bias force allowing fluid flow from said crossover port through said first fluid channel and into the vacuum port outlet;

a first adjuster operable by the user being operable in connection with said first ball valve and spring, said first adjuster is positioned to increase or decrease the force on said spring biasing said first ball valve resulting in a varying of said preset vacuum transition level such that fluid flow will be blocked or allowed to flow through the crossover port and through the first fluid channel;

a second fluid channel including in its pathway a second ball valve being operable within said second fluid channel such that fluid flow is permitted under all vacuum levels through an outlet orifice between said second fluid channel and said vacuum outlet port, said outlet orifice remaining dimensionally unchanged with respect to engine vacuum level;

a second adjuster being operable by the user for dimensionally altering the outlet orifice geometry between said second fluid channel and said vacuum port outlet thereby altering flow rate under all vacuum conditions;

a third adjuster operable by the user for dimensionally altering the orifice geometry of said crossover channel port between said first fluid channel and said second fluid channel thereby altering flow rate only when vacuum is below the preset vacuum transition level;

whereby an idle mode singular fluid flow path regulating the idle flow rate may be increased or decreased by the user operating the second adjuster when the engine is operating at a vacuum level exceeding the preset vacuum transition level, with the first adjuster being operable to change the preset vacuum transition level, fluid flows through said second fluid channel only, thereby making the idle flow rate governed by the outlet orifice between the second fluid channel and the vacuum outlet port with said second adjuster being operable to dimensionally change the second fluid channel outlet orifice geometry increasing or decreasing fluid flow, and whereby a cruise mode dual flow path regulating the cruise flow rate may be increased or decreased by the user operating the third adjuster in conjunction with the second adjuster, when the engine is operating at a low vacuum level below the preset vacuum transition level, with the first adjuster being operable to change the preset vacuum transition level, fluid flows through the second fluid channel while also allowing an additional fluid flow through the first fluid channel via the crossover port thereby making the cruise flow rate governed by both the outlet orifice of the second fluid channel and the crossover port between the first and second fluid channel, said second adjuster being operable to dimensionally change the second fluid channel outlet orifice geometry increasing or decreasing fluid flow and the third adjuster being operable to dimensionally change the crossover port geometry increasing or decreasing fluid flow, and whereby said first and second ball valves in said first and second fluid channels block any reverse fluid flow from the manifold air intake into the engine crankcase under conditions when the manifold air intake is under pressure rather than vacuum, said first ball valve sealing off said first fluid channel inlet port and said second ball valve sealing off said second fluid channel inlet port.

2. The multi-channel positive crankcase ventilation PCV valve of claim 1, wherein said third adjuster for controlling the rate of flow between the first and second fluid channels extending into the crossover port flow channel extends through the bottom of the PCV valve.

3. The multi-channel positive crankcase ventilation PCV valve of claim 1, wherein the rate of flow through the crossover port being controlled through the increase or decrease of the diameter of the crossover port.

4. The multi-channel positive crankcase ventilation PCV valve of claim 1, wherein the rate of flow through the crossover port being controlled through the increase or decrease of the depth of the crossover port.

5. The multi-channel positive crankcase ventilation PCV valve of claim 1, wherein the rate of flow through the crossover port channel being controlled through the increase or decrease of the flow in the crossover port channel by altering the inward position of the third adjuster.

6. The multi-channel positive crankcase ventilation PCV valve of claim 1, wherein the preset vacuum transition level of the PCV valve is altered by the inward and outward adjustment of the first adjuster.

7. The multi-channel positive crankcase ventilation PCV valve of claim 1, wherein said third adjuster for controlling the rate of flow between the first and second fluid channels extending into the crossover port flow channel extends through the side of the PCV valve.

8. The multi-channel positive crankcase ventilation PCV valve of claim 1, wherein the overall flow rate through the PCV valve is altered by the inward and outward adjustment of the second adjuster.

9. The multi-channel positive crankcase ventilation PCV valve of claim 1, wherein the spring associated with said first adjuster is removed from said first fluid channel for operating the PCV valve in a fixed orifice mode.

10. The multi-channel positive crankcase ventilation PCV valve of claim 1, wherein under positive pressure conditions, the first and second ball valves block the first fluid channel and second fluid channel respectively, completely preventing all reverse flow from an engine manifold air intake to the PCV vacuum port outlet preventing positive pressure gases from passing into the engine crankcase.

* * * * *